US007540719B2

(12) United States Patent
Umemura

(10) Patent No.: US 7,540,719 B2
(45) Date of Patent: Jun. 2, 2009

(54) POWER TRANSMISSION AND COMPRESSOR

(75) Inventor: Yukio Umemura, Yokohama (JP)

(73) Assignee: Calsonic Kansei Corporation, Tokyo (JP)

( * ) Notice: Subject to any disclaimer, the term of this patent is extended or adjusted under 35 U.S.C. 154(b) by 562 days.

(21) Appl. No.: 10/687,741

(22) Filed: Oct. 20, 2003

(65) Prior Publication Data

US 2004/0086392 A1 May 6, 2004

(30) Foreign Application Priority Data

Oct. 21, 2002 (JP) ..... 2002-306124
Oct. 21, 2002 (JP) ..... 2002-306139
Jan. 16, 2003 (JP) ..... 2003-008309
Jan. 16, 2003 (JP) ..... 2003-008315

(51) Int. Cl.
*F04B 49/00* (2006.01)
*F16D 43/20* (2006.01)

(52) U.S. Cl. ..... 417/223; 192/56.5; 192/56.51; 417/362; 464/30

(58) Field of Classification Search ..... 192/56.5, 192/56.1, 56.51; 417/362, 223; 464/30
See application file for complete search history.

(56) References Cited

U.S. PATENT DOCUMENTS 1,865,559 A * 7/1932 De Montgrand ..... 74/64
2,256,781 A * 9/1941 Nelson ..... 192/150
2,673,633 A * 3/1954 Miller et al. ..... 192/104 R
4,287,974 A 9/1981 Krejci
4,825,992 A * 5/1989 Skrobisch ..... 192/56.4
5,683,299 A * 11/1997 Kishibuchi et al. ..... 464/88
5,944,156 A * 8/1999 Hatakeyama ..... 192/56.5
2002/0162720 A1* 11/2002 Kimura et al. ..... 192/55.1

FOREIGN PATENT DOCUMENTS

EP 0 922 875 A2 6/1999
EP 1 179 678 A2 2/2002
EP 1197672 * 4/2002
JP 47-17032 U 10/1972
JP 48-059254 U 8/1973
JP 10-252772 A 9/1988
JP 3-228595 A 10/1991
JP 10-196588 A 7/1998
JP 10-267047 A 10/1998
JP 2000-087850 A 3/2000

(Continued)

OTHER PUBLICATIONS

Patent Abstracts of Japan, vol. 1996, No. 09, Sep. 30, 1996, JP 08-135752, May 31, 1996.

(Continued)

*Primary Examiner*—Devon C Kramer
*Assistant Examiner*—Leonard J Weinstein
(74) *Attorney, Agent, or Firm*—Foley & Lardner LLP

(57) ABSTRACT

A power transmission for a compressor includes a driven member rotable by an engine. The power transmission includes a drive member rotable coaxially with the driven member to rotate a shaft of a compressor for regulating displacement of the compressor. The power transmission includes a link interconnecting the driven member and the drive member with each other in a crossing direction relative to the drive shaft. The link is disengageable from one member of the driven member and the drive member.

15 Claims, 13 Drawing Sheets

FOREIGN PATENT DOCUMENTS

| | | | |
|---|---|---|---|
| JP | 2000-161382 | A | 6/2000 |
| JP | 2000-192992 | A | 7/2000 |
| JP | 2001-108070 | A | 4/2001 |
| JP | 2003-028191 | A | 1/2003 |
| JP | 2003-035321 | A | 2/2003 |
| JP | 2003-035322 | A | 2/2003 |
| JP | 2003-056595 | A | 2/2003 |
| JP | 2003-139161 | A | 5/2003 |
| JP | 2003-148510 | A | 5/2003 |
| JP | 2004-197928 | A | 7/2004 |
| JP | 2004-197929 | A | 7/2004 |

OTHER PUBLICATIONS

Patent Abstracts of Japan, vol. 1996, No. 09, Sep. 30, 1996, JP 08-121333, May 14, 1996.

Patent Abstracts of Japan, vol. 1999, No. 01, Jan. 29, 1999, JP 10-267048, Oct. 6, 1998.

* cited by examiner

POWER TRANSMISSION AND COMPRESSOR

BACKGROUND OF THE INVENTION

The present invention relates to a power transmission and a compressor employing the power transmission. The compressor includes a displacement compressor and a turbocompressor. The displacement compressor includes a reciprocating compressor and a rotating compressor. The reciprocating compressor includes a swash-plate, a wobble-plate, a crank, and a Scotch yoke compressor.

A conventional power transmission is adapted to a clutchless compressor, as referred in Japanese Patent Application Publication Laid-open No. 2000-87850. The compressor includes a boss in a housing. The boss rotatably supports a pulley, using a bearing. The housing houses a shaft. The shaft is disposed coaxially with the boss, projecting outwardly from the boss. The shaft has an end fixed to a hub.

The hub has a cover member fixed thereto, using a rivet. The cover member has recesses at the peripheral edge. The recesses are arranged on the identical circle about the shaft at an angular interval. Each of the recesses has a cushioning rubber therein which are adhered thereto. Each end of the recesses has a hole which rotatably houses a ball, a part of which is projected from the hole.

The pulley has a face opposed to the cover member. The face has a first hole on the identical circle, in which the ball is rotatably housed. The identical circle has a second hole thereon, in which the ball, disengaged from the first hole, drops.

The outer periphery of the pulley has a belt applied thereto. The belt is connected to a crank shaft. When driving an engine, the pulley is rotated, and power is transmitted to the shaft through the cushioning rubber, the cover member and the hub.

It is supposed that the clutchless compressor produces an abnormality such as seizing therein, and load torque goes over a predetermined value. Respective cushioning rubbers are deformed to disengage from balls. Respective balls are pressed by the cover member and are disengaged from first holes, going into second holes. This cuts off transmission of power from the pulley to the shaft, thus idling the pulley.

The conventional art has a complicated structure, the large number of components and productive steps, and high productive cost. In the conventional art, wear or age deterioration on the cushioning rubber reduces the threshold value of load torque when transmission of torque toward the compressor is cut off.

SUMMARY OF THE INVENTION

The invention is directed to a power transmission and a compressor, which has a simplified structure for shortening production time and reducing production cost.

The invention is directed to a power transmission and a compressor, which reduces a shaft of a compressor in axial dimension.

The invention is directed to a power transmission and a compressor, which prevents reduction of the threshold of load torque when transmission of power toward the compressor is cut off, thus enhancing reliability.

A first aspect of the invention provides a power transmission for a compressor. The power transmission includes a driven member rotatable by an engine. The power transmission includes a drive member rotatable coaxially with the driven member to rotate a shaft of a compressor for regulating displacement of the compressor. The power transmission includes a link interconnecting the driven member and the drive member with each other in a crossing direction relative to the drive shaft. The link is disengageable from one member of the driven member and the drive member.

Preferably, the link is rotatably mounted to the other member of the driven member and the drive member.

Preferably, the other member includes a locking member configured to lock with the link disengaged from the one member.

Preferably, the locking member includes a resilient member slidably pressing the link against the other member.

Preferably, the one member includes a first engagement member. The other member of the driven member and the drive member includes a second engagement member. The link includes a first hole fitted with the first engagement member. The link includes a guide extending from the first hole to an end edge of the link. The link includes a second hole fitted with the second engagement member.

Preferably, the first engagement member is deformable.

Preferably the first engagement member is integrated with the one member. The second engagement member is integrated with the other member.

Preferably, the link is interposed between the driven member and the drive member.

Preferably, the link includes plates of an identical shape and dimension stacked on each other.

Preferably, the link is deformable to disengage from the one member.

Preferably, the first engagement member passes through the guide to disengage from the link.

Preferably, links are arranged about the shaft at an equal angular interval.

A second aspect of the invention provides a compressor for a vehicle. The compressor includes a shaft for regulating displacement. The compressor includes a driven member rotatable by an engine. The compressor includes a drive member rotatable coaxially with the driven member to rotate the shaft. The compressor includes a link interconnecting the driven member and the drive member. The link is deformable to disengage from one member of the driven member and the drive member.

BRIEF DESCRIPTION OF THE ACCOMPANYING DRAWINGS

DETAILED DESCRIPTION OF THE PREFERRED EMBODIMENTS

Embodiments of the invention will hereby be described with reference to the drawings.

Figure 1:
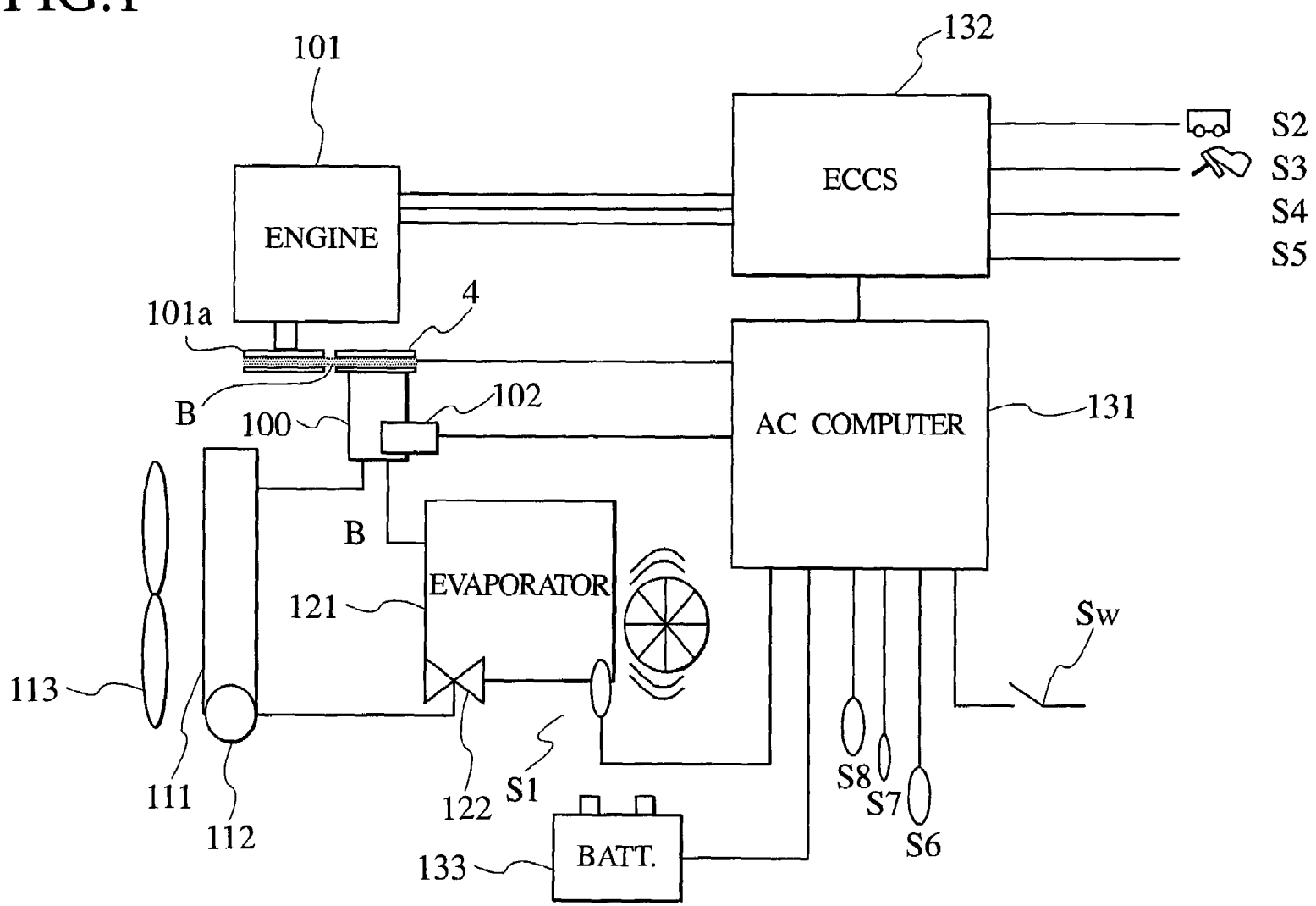
FIG. 1 is a schematic view of an air conditioning system according to the first embodiment of the invention.

In FIG. 1, an air conditioning system includes a refrigeration-cycle and a controller thereof. The refrigeration-cycle includes a swash plate compressor 100 to compress a vaporized coolant. The refrigeration-cycle includes a condenser 111 to liquefy a coolant. The refrigeration-cycle includes an evaporator 121 to vaporize a liquefied coolant.

The compressor 100 includes a pulley 4 for drive which is coupled to a pulley 101*a* of engine 101, using a belt B. The compressor includes an electronic control valve 102 downstream.

The condenser 111 has a cooling fan 113. The condenser includes a liquid tank 112.

The controller includes an AC computer 131 driven by a battery 133. The AC computer 131 obtains information from sensors S1, S6, S7 and S8. The sensor S1 detects a temperature at the outlet of evaporator 121. The sensor S6 detects a temperature of vehicle's interior. The sensor S7 has a solar radiation sensor. The sensor S8 detects a temperature outside the vehicle. The AC computer 131 controls the electronic control valve 102.

The controller includes ECCS (electronic concentrated engine control system) 132. The ECCS 132 obtains information from sensors S2, S3, S4 and S5 to control engine 101. The sensor S2 detects vehicle's speed. The sensor S3 detects the opening rate of an accelerator. The sensor S4 detects the rotational speed of a wheel or an axle. The sensor S5 detects a suction air pressure of engine 101.

Figure 2:
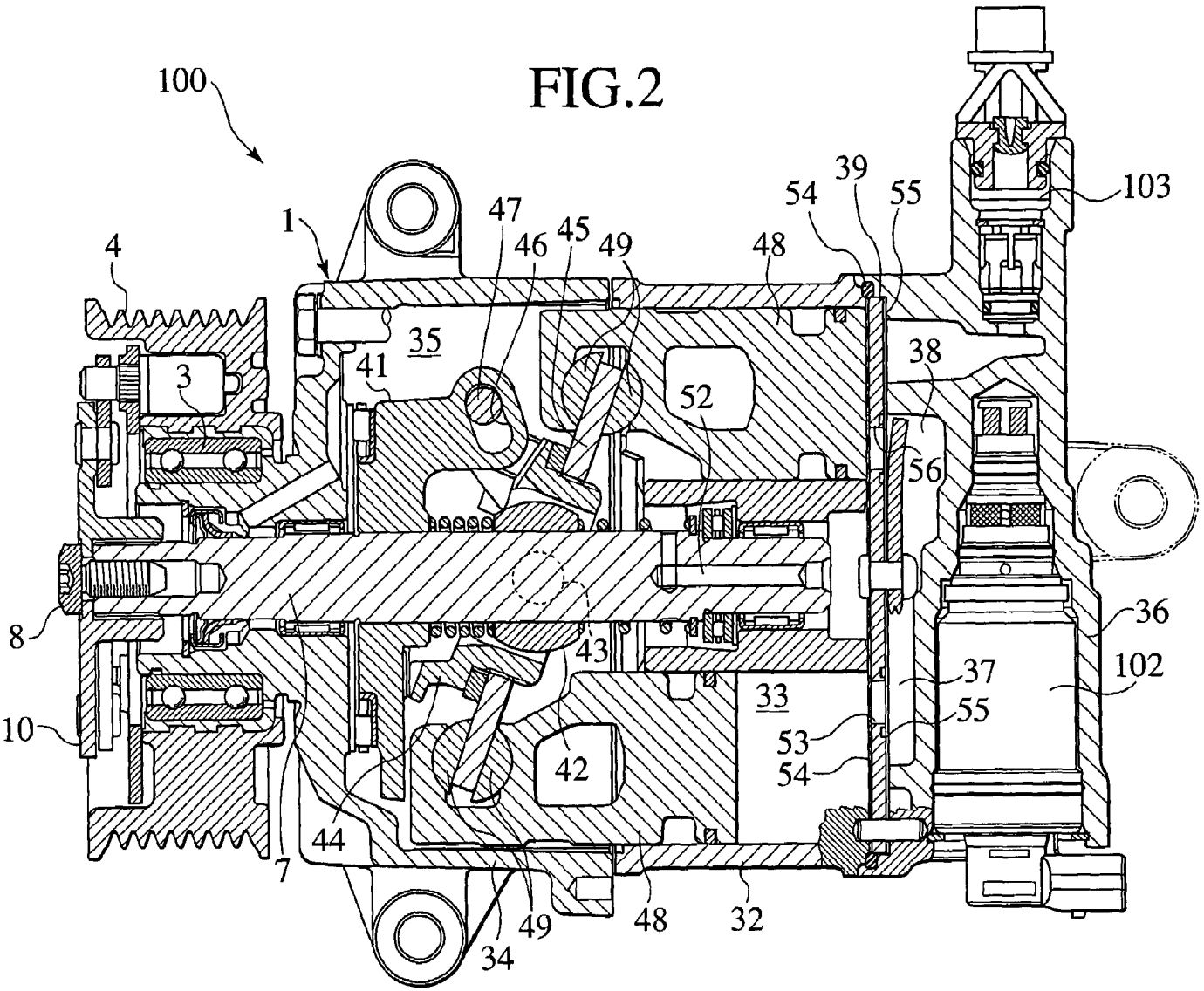
FIG. 2 is a cross-sectional view of a compressor in FIG. 1.

In. FIG. 2, the swash plate compressor 100 includes a cylinder block 32 defining six cylinder bores 33 around a shaft 7 in a housing 1. Each of the cylinder bores 33 houses a cylinder 48 axially slidable therein. The compressor 100 includes a front housing 1 defining a crank chamber 35 adjacent to the cylinder block 32.

The compressor 100 includes a rear housing 36 which defines coolant suction chamber 37 and coolant discharge chamber 38 in communication with the cylinder bores 33. The cylinder bores 33 and coolant suction and discharge chambers 37, 38 are separated from each other by a valve plate 39. The valve plate 39 has inlets 53 and outlets 56 interconnecting cylinder bores and suction and discharge chambers 37, 38. The valve plate 39 has suction plates 54 which cover inlets 53 on the cylinder bores 33. The valve plate has discharge plates 55 which cover outlets 56 on the discharge chamber 38.

The crank chamber 35 includes a drive plate 41 fixed to a shaft 7. The crank chamber 35 includes a sleeve 42 slidably fitted with the shaft 7. The crank chamber 35 includes a journal 44 swingably connected to shaft 7, using pin 43. The crank chamber 35 includes a swash plate 45 fixed to the outer end of journal 44.

The journal 44 connects to an elongated arced hole 46 of drive plate 41 which restricts a swing motion.

The pistons 48 are connected to the swash plate 45, using a pair of shoes 49, with the swash plate 45 interposed between shoes 49.

The shaft 7 is connected to the pulley 4 for rotation. The pulley 4 is rotatably supported by bearing 3 on the front housing 1.

The compressor 100 includes an electronic control valve 102 and a check valve 103 in a rear housing 36. The control valve 102 feeds a part of a compressed coolant in discharge chamber 38 to the crank chamber 35 through a passage 52 for regulating pressure in crank chamber 35.

The swash plate 45 is controlled at an inclined angle by differential pressure between suction chamber 37 and crank chamber 35. The angular change of swash plate 45 changes the stroke of each piston 48, which changes the discharge volume of a coolant.

Figure 4:
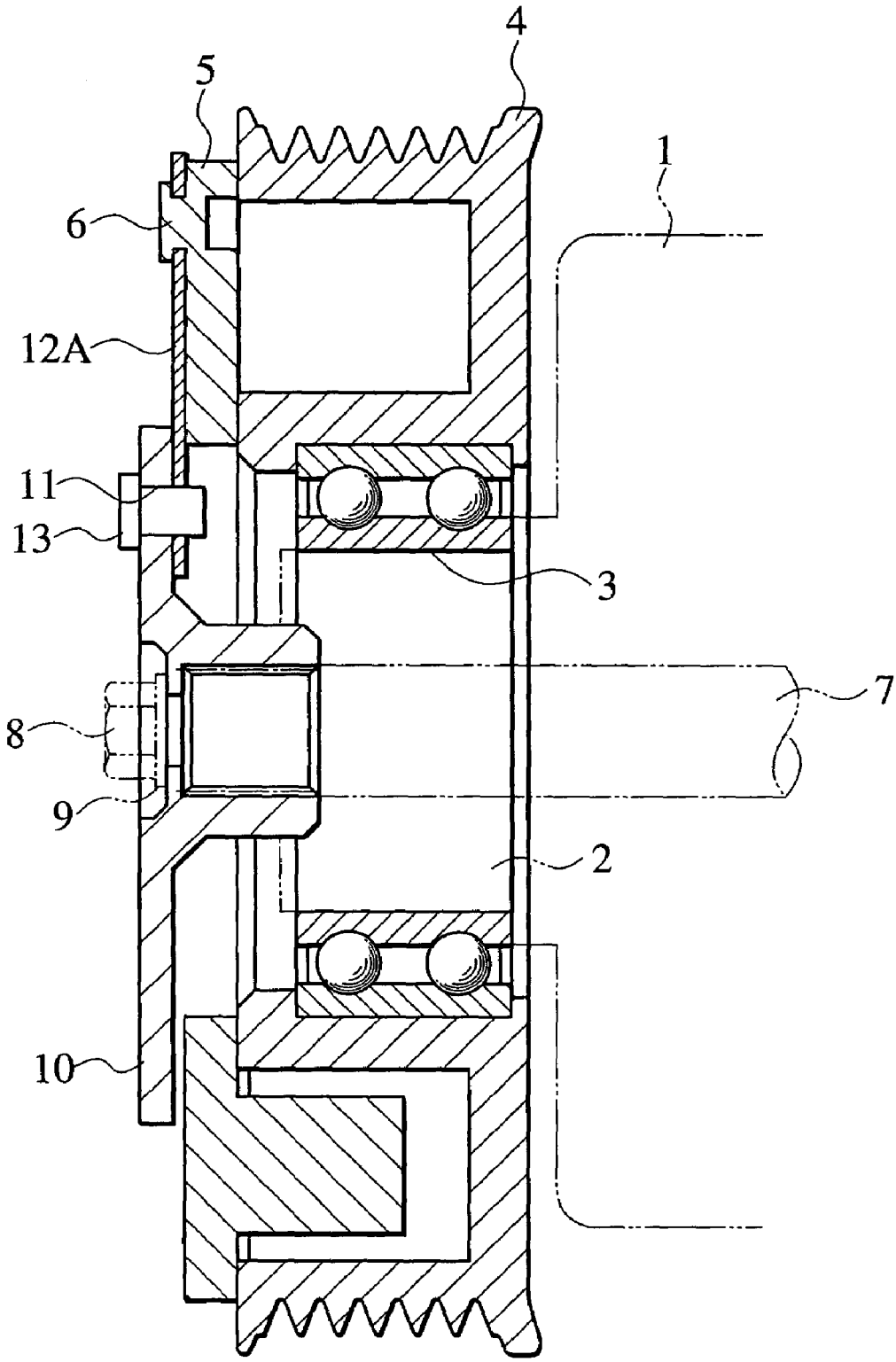
FIG. 4 is a cross-sectional of the power transmission taken along IV-IV in FIG. 3.

In FIG. 4, clutchless compressor 100 has housing 1 with a boss 2. The boss 2 has the pulley 4 rotatably supported thereon, using the bearing 3. The pulley 4 has drive plate 5 fixed on the end face thereof, using a bolt. The drive plate 5 includes cylinder-shaped protrusions 6 on the side thereof. The protrusions 6 are arranged on the identical circle about shaft 7 at an angular interval. The pulley 4 and drive plate 5 constitutes a first transmission member or a driven member.

Figure 3:
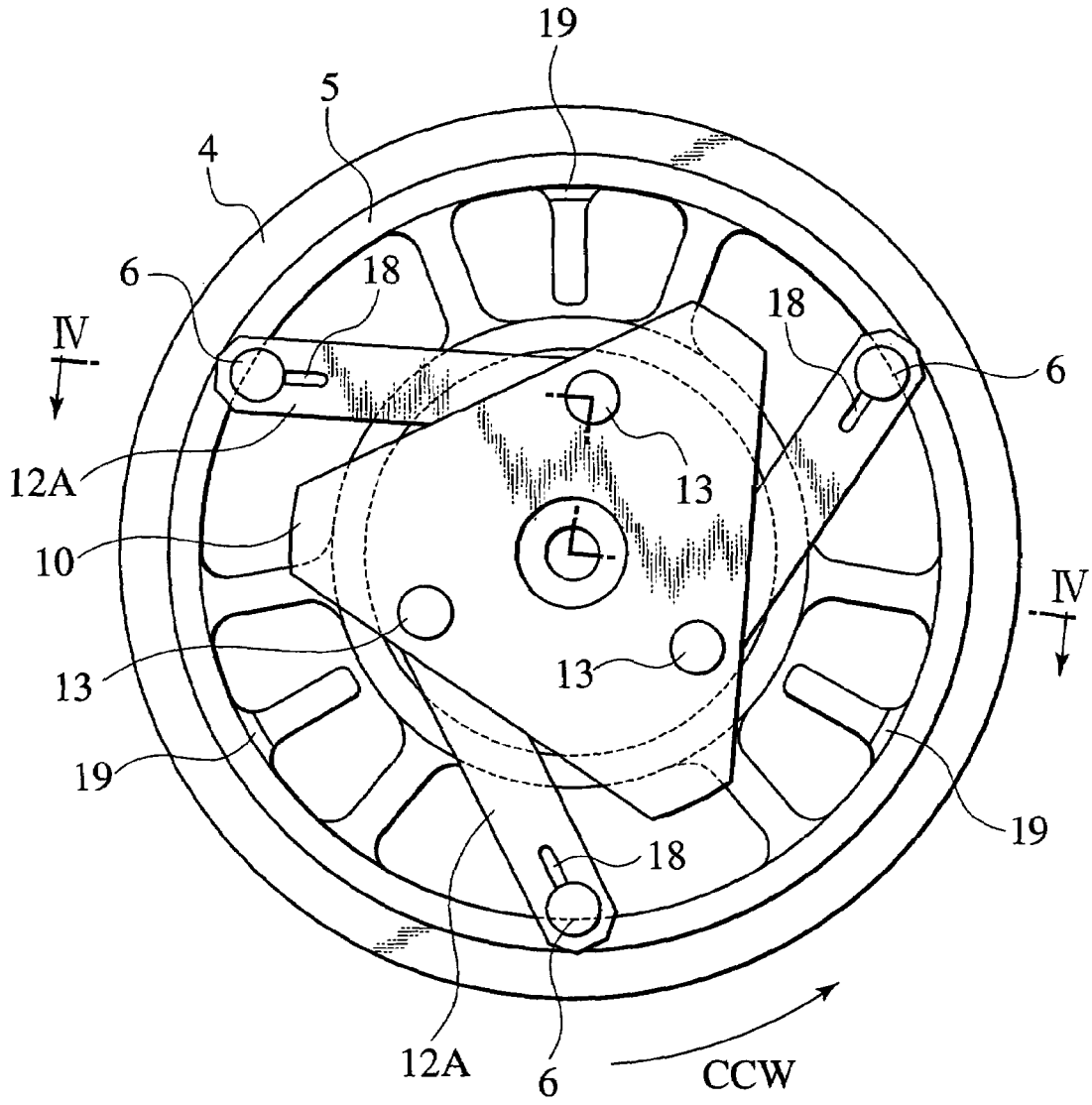
FIG. 3 is an elevation view of a power transmission in FIG. 2.

The housing 1 is coaxial with the boss 2, and houses shaft 7 which projects outward from the boss 2. The shaft 7 has an end which is fixed to hub 10 (second transmission member or drive member), using a bolt 8 and a washer 9. As shown in FIG. 3, hub 10 is shaped as a triangle. The hub 10 has pin insertion holes 11 (refer to FIG. 4), which are positioned on the identical circle about shaft 7 at an angular interval of 120 degree.

Figure 6:
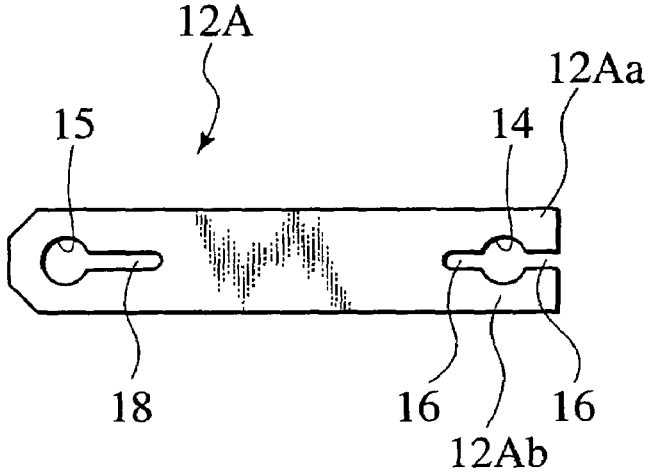
FIG. 6 is a plane view of a leaf spring in FIG. 3.

The hub 10 connects with drive plate 5, using belt-plate shaped leaf springs or links 12A of the identical shape and dimension. The leaf spring 12A is made of a spring of a high-carbon steel. The leaf springs 12A are arranged between drive plate 5 and hub 10 and parallel with a direction normal to the shaft 7. For example, the leaf springs 12A extend tangentially from hub 10 to pulley. In FIG. 6, each of leaf springs 12A has a through-hole 14 at one longitudinal end, which is rotatably fitted with the outer periphery of pin (protrusion) 13 that passes through insertion-hole 11. Each of the leaf springs 12A has a second through-hole 15 at the other longitudinal end, which is rotatably fitted with the outer periphery of a protrusion 6.

Each of the leaf springs 12A has a slit 16 extending longitudinally from one end edge toward the other end and over the first through-hole 14. One end of leaf spring 12A includes a pair of side pieces 12A*a*, 12A*b* opposed to each other. Each of side pieces 12A*a*, 12A*b* defines slit 16 and first through-hole 14 therebetween. The first through-hole 14 is slightly smaller in size than the pin 13. The fitting of pin 13 into the first through-hole 14 allows the inner periphery of first through-hole 14 to be pressed against the outer periphery of pin 13 under a resilient force of leaf spring 12A. This allows both peripheries to be in tight contact with each other without a gap. It is supposed that compressor 100 produces seizing inside thereof, and load torque goes over a predetermined value. The width of slit 16 is set for the pin 13 fitted in first through-hole 14 to press and widen the slit 16 so as to come out of the slit 16.

Each of leaf springs 12A has a slit 18 extending longitudinally from the second through-hole 15 toward the other end. The second through-hole 14 is slightly smaller in size than protrusion 6. The protrusion 6 is pressed into the second through-hole 15 before the head of protrusion 6 is riveted. The pressing allows the inner periphery of second through-hole 15 to be pressed against the outer periphery of protrusion 6 under resilient force by leaf spring 12, thus eliminating the gap between both peripheries. The riveting of the head of protrusion 6 as a flange prevents the leaf spring 12A from coming out of protrusion 6, as shown in FIG. 4.

Next, operation of the power transmission is described. Power of the engine 101 is applied to pulley 4 through the belt B. It is supposed that load torque on the compressor is lower than a predetermined value. Power from engine 101 is transmitted to hub 10 through the protrusion 6, leaf spring 12A, and pin 13, rotating shaft 7. The rotating shaft 7 rotates swash plate 45 to control the stroke of pistons 48.

It is supposed that seizing inside the compressor 100 causes the load torque to go over a predetermined value. Each of pins 13 is firmly pressed against the portion of slit 16 in proximity to the tip end of leaf spring 12A. The portion of slit 16 or side pieces 12A*a*, 12A*b* are pressed and widened transversely. This allows the pin 13 fitted in the first through-hole 14 to be disengaged from the leaf spring 12A through the slit 16. The disengagement cuts off transmission of power from pulley 4 to shaft 7, thus idling pulley 4. The pin 13 may be replaced by a resilient cylinder, which is resiliently deformed to pass through the slit 16.

The leaf spring 12A of a spring or resilient material resists time-varying or wearing, and the leaf spring 12A is deformed to cut off transmission of power. This stabilizes the threshold value of load torque, achieving accurate cutting-off of transmission of power.

Especially, the embodiment is structured as the leaf springs 12A of the identical shape and dimension are arranged symmetrically about shaft 7 at an equal angular interval. The arrangement reduces influence on leaf springs 12A due to variation of strength and dimension, and advantageously facilitates to cut off power due to the threshold value of a desired load torque.

Figure 5:
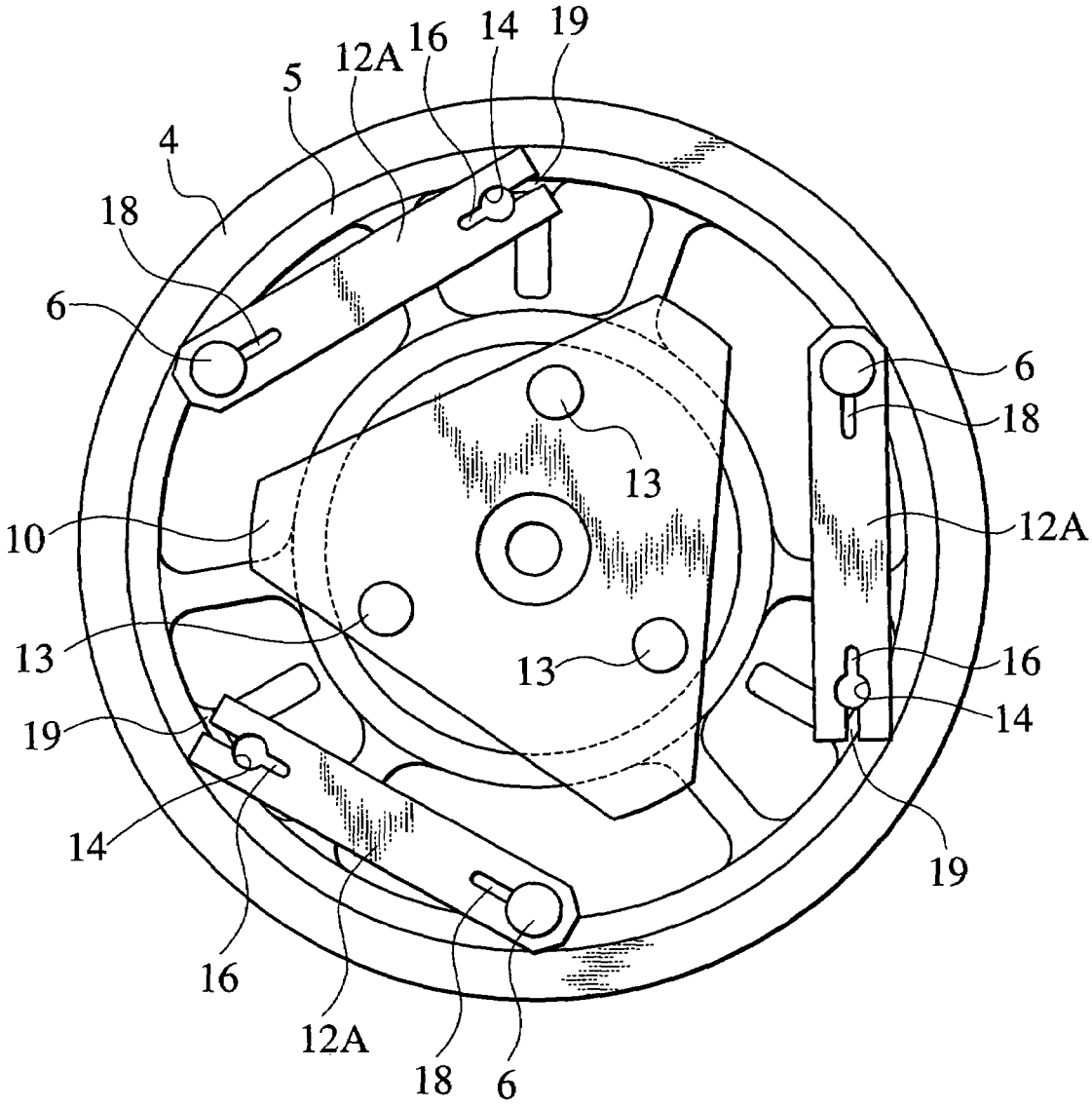
FIG. 5 is an elevation view of the power transmission after power-off.

Each of the leaf springs 12A disengaged from the pin 13 is rotatable about protrusion 6. A leaf spring 12A hits upon a neighboring pin 13 to rotate toward the outer periphery of pulley 4. The leaf spring 12A runs on and locks with protrusion-shaped locking member 19 formed to drive plate 5, under centrifugal force (refer to FIG. 5). In this state, the hub 10 and pin 13 do not contact with the leaf spring 12A, and noise does not occur.

The power transmission has a simple structure, and a smaller number of components and production steps in comparison with the conventional art's structure. This shortens production time and reduces production cost.

Each of the leaf springs 12A in a plate-shape is arranged between the drive plate 5 and hub 10 and parallel to a direction normal to the shaft 7. Thus, the shaft 7 has a small dimension in an axial direction, which advantageously facilitates installation of the clutchless compressor at a position.

Next, the second embodiment of the invention is described. In respective embodiments, portions identical to ones of the first embodiment are applied to the identical reference numerals, and overlapped description is omitted.

Figure 7:
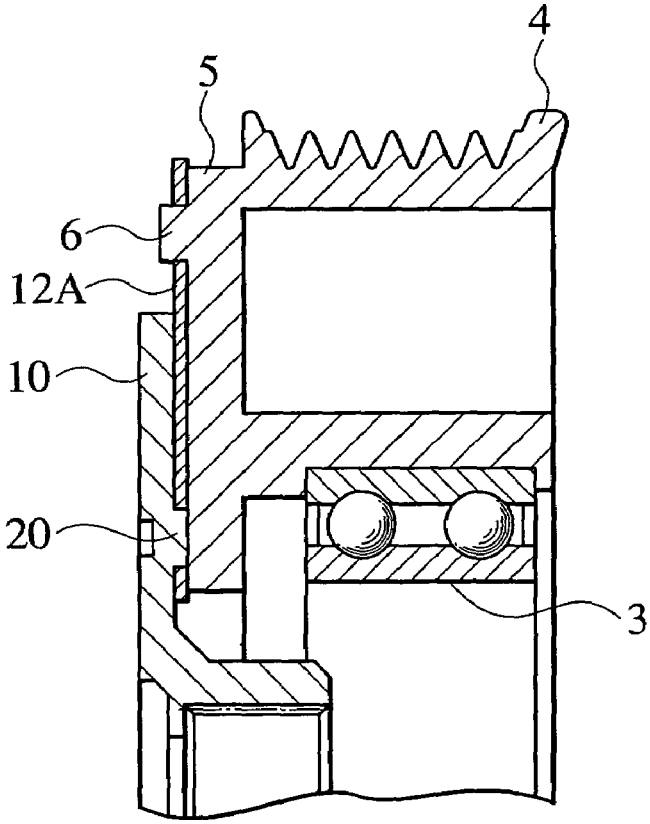
FIG. 7 is a partial sectional view of a power transmission according to the second embodiment.

In FIG. 7, the embodiment has protrusions 20 formed integrally to the face hub 10, in place of the pins 13 of the first embodiment. The protrusions 20 are fitted in one ends of leaf springs 12A. The other ends of leaf springs 12A has protrusions 6 rotatably fitted therein. The protrusions 6 are integrally formed to the pulley 4. This further reduces the number of components, which shortens production time and reduces production cost.

According to the embodiment, the leaf springs 12A are interposed between the hub 10 and pulley 4, and are restricted to move in a thickness direction thereof This requires no riveting of protrusions 6 for preventing of leaf springs 12A from coming out of protrusions 6. This further reduces production cost.

Next, the third embodiment of the invention is described.

Figure 8:
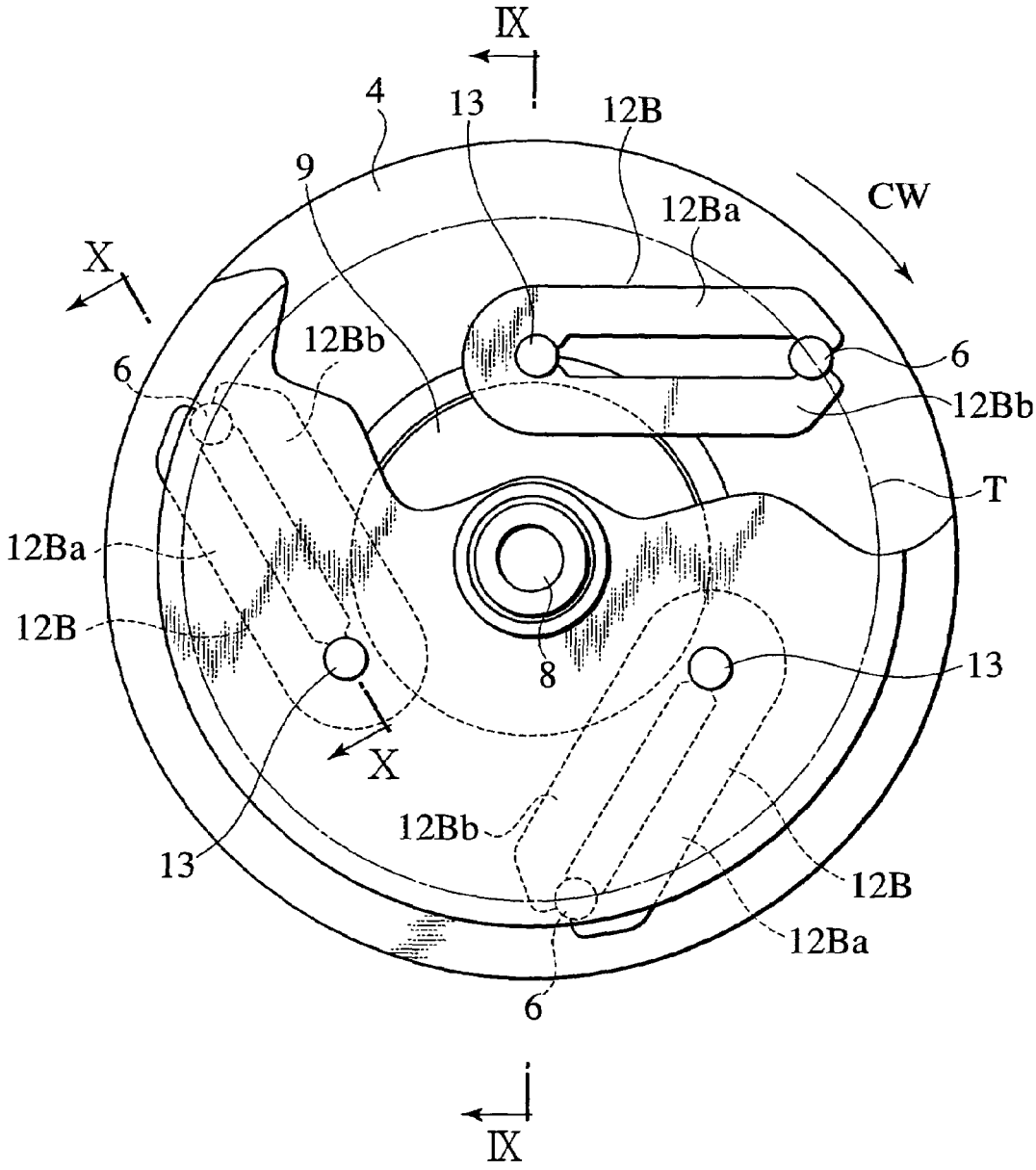
FIG. 8 is a partially broken elevation view of a power transmission according to the third embodiment.

Referring to FIG. 8, in the embodiment, respective leaf springs 12B include a pair of bifurcate side pieces 12Ba, 12Bb connected to each other. Each of leaf springs 12B has the side pieces 12Ba, 12Bb on one end side, which radially crimp the outer periphery of protrusion 6. Each of leaf springs 12B has the other end side rotatably supported by pin 13. Leaf spring 12B has two plates 12B1, 12B2 of the identical shape and dimension. The plates 12B1, 12B2 are stamped out in a shape, and are stacked on each other in the thickness direction. This facilitates stamping for enhancing workability, and resists burr and deformation for enhancing dimensional accuracy.

The embodiment has a locking member 19 of a resilient member as a washer. The locking member 19 is a fitted concentrically with the outer periphery of shaft part 10*a* of hub 10. The locking member has a peripheral edge bent toward the flange 10*b* of hub 10. The locking member 19 slidably presses respective leaf springs 12B against the rear side of flange 10*b* of hub 10 for locking.

Figure 11A:
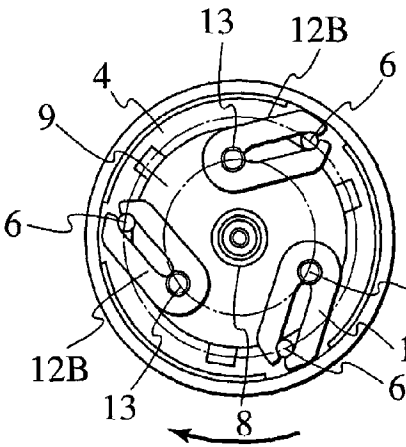
FIGS. 11A to 11E are elevation views illustrating operation of the power transmission in FIG. 8.
Figure 11B:
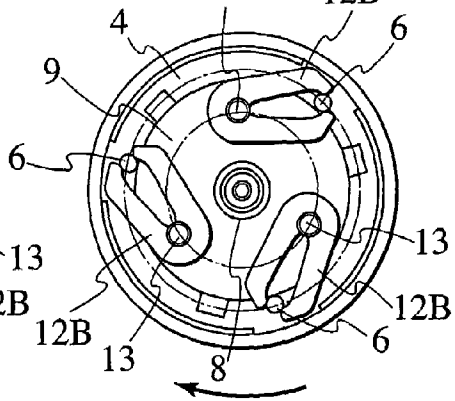
Figure 11C:
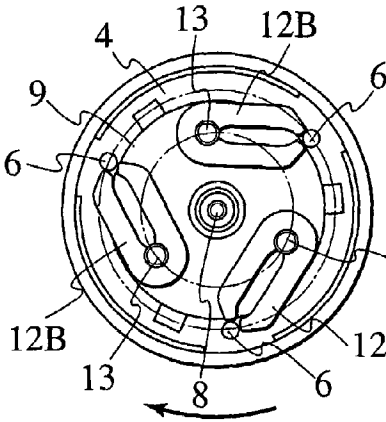
Figure 11D:
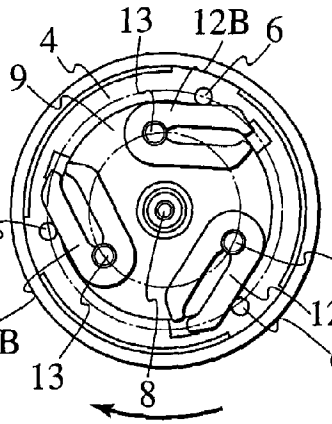
Figure 11E:
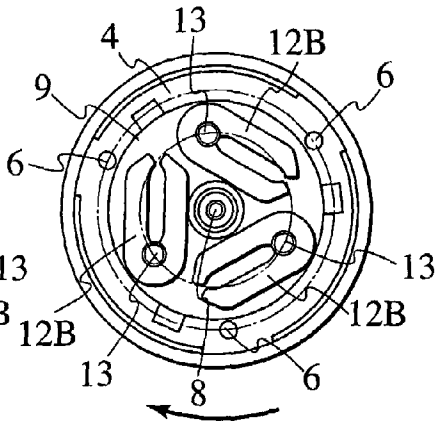
Figure 12:
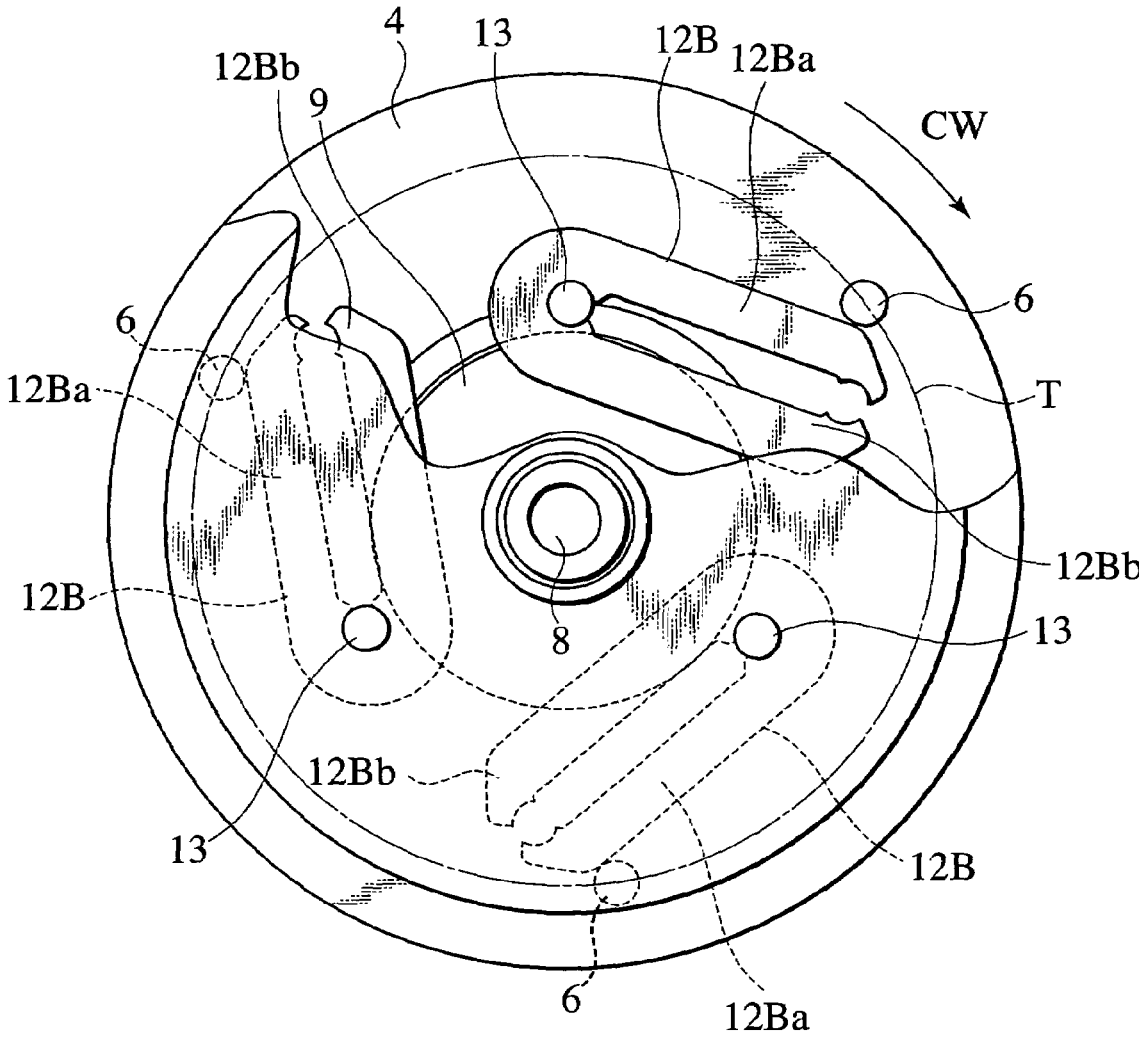
FIG. 12 is a partially broken elevation view of the power transmission of FIG. 8 after cutting off power.

According to the power transmission, it is supposed that the compressor has a load torque over a certain value. In FIGS. 11B, 11C, each of protrusions 6 presses and widens the ends of the side pieces 12B*a*, 12B*b* on one end side of leaf spring 12B, disengaging from the leaf spring 12B. The disengagement cuts off transmission of power from the pulley 4 to hub 10. In FIG. 11D, each of leaf springs 12B comes against a protrusion 6 that rotates along an orbit T indicated by the dotted line. In FIGS. 11E and 12, leaf springs 12B rotate inside of the orbit, sliding on the locking member 19. The leaf springs 12B is locked in a region without contacting protrusions 6.

According to the embodiment, the leaf springs 12B disengages from pulley 4 rotating after cutting off transmission of power. In the case, leaf springs 12B does not rotate during maintenance. Thus, the embodiment prevents hitting of the leaf springs 12B upon an operator and injury to the operator.

Figure 9:
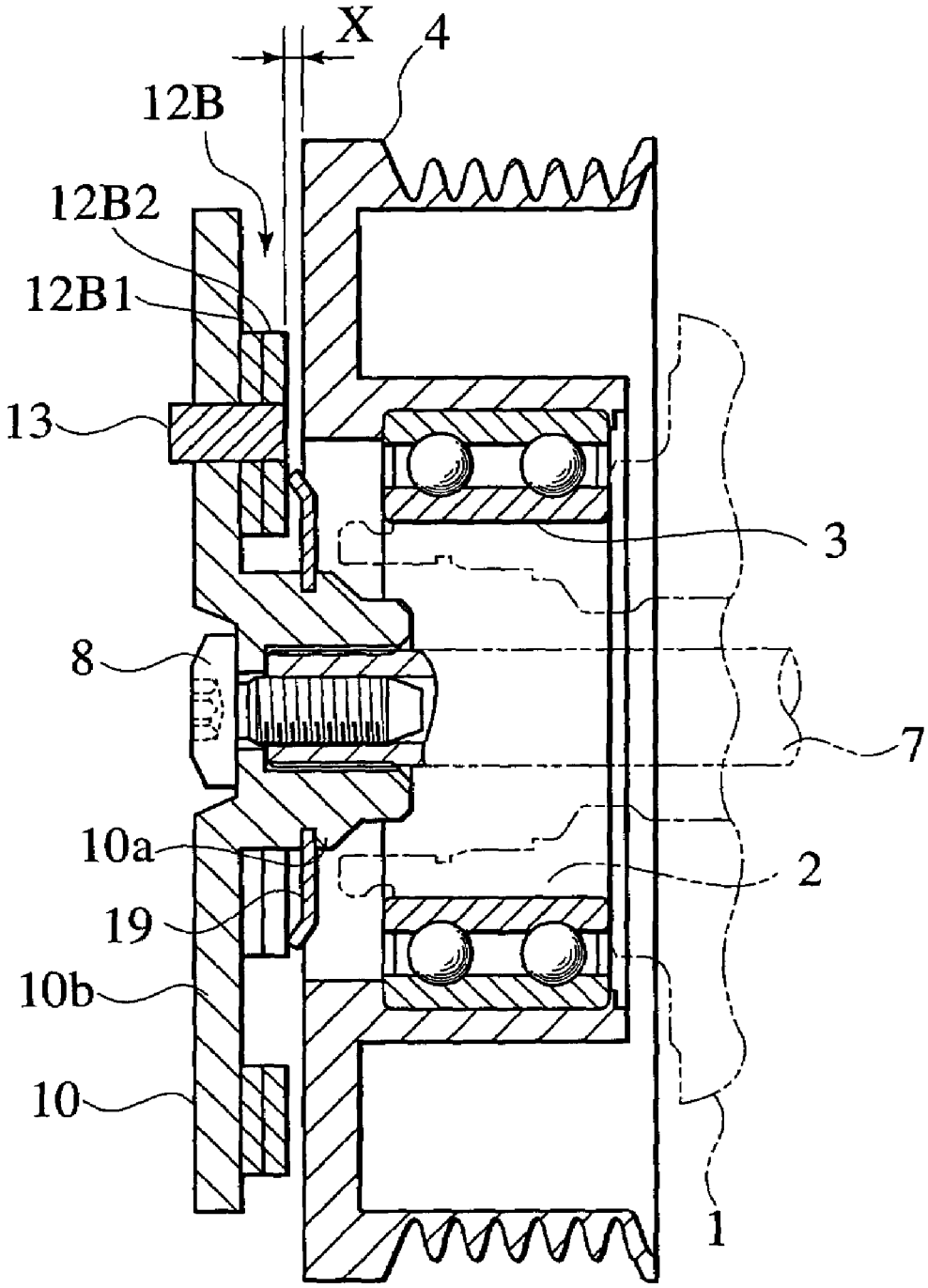
FIG. 9 is a sectional view of the power transmission taken along IX-IX in FIG. 8.
Figure 10:
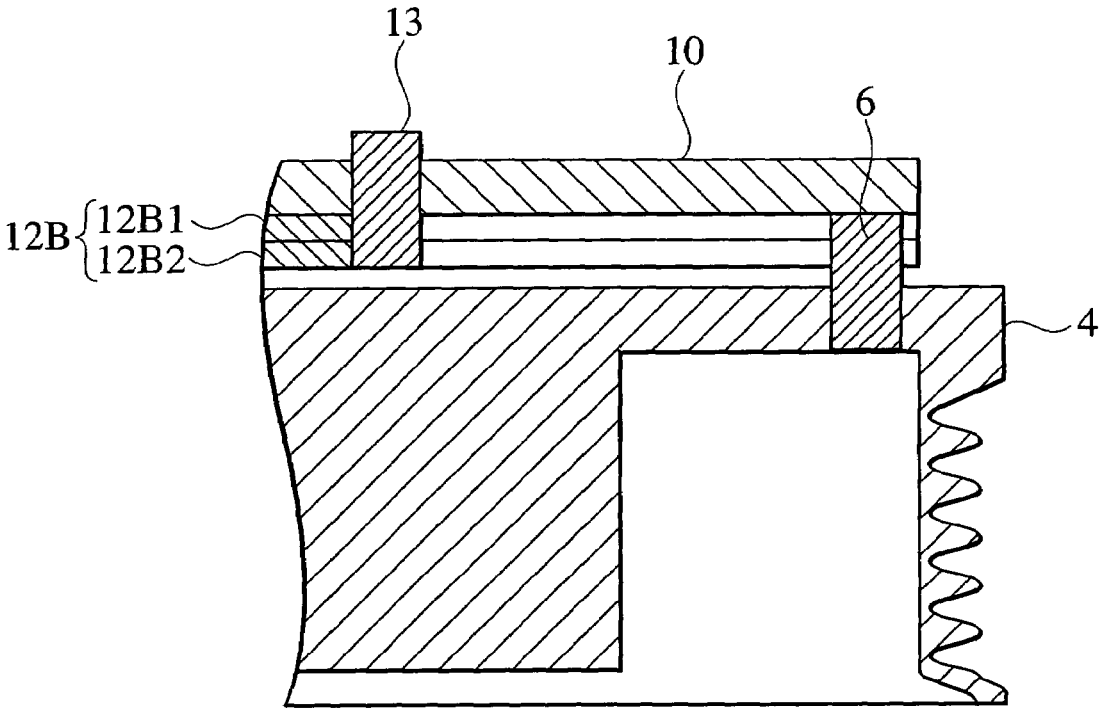
FIG. 10 is a partial sectional view of the power transmission taken along X-X in FIG. 8.

The clearance between the leaf spring 12B and pulley 4 requires width X more than a predetermined size, as referred in FIG. 9. Without means for positioning the leaf springs 12B in an axial direction of the shaft 7, dimensional variation of components causes a width X less than a predetermined size. Thus, a shim is required to be inserted between the tip face of shaft 7 and hub 10 for adjustment. As the embodiment, the locking member 19 presses the leaf springs 12B against hub 10. This ensures a width X more than a predetermined size, advantageously saving time for adjustment.

Figure 13:
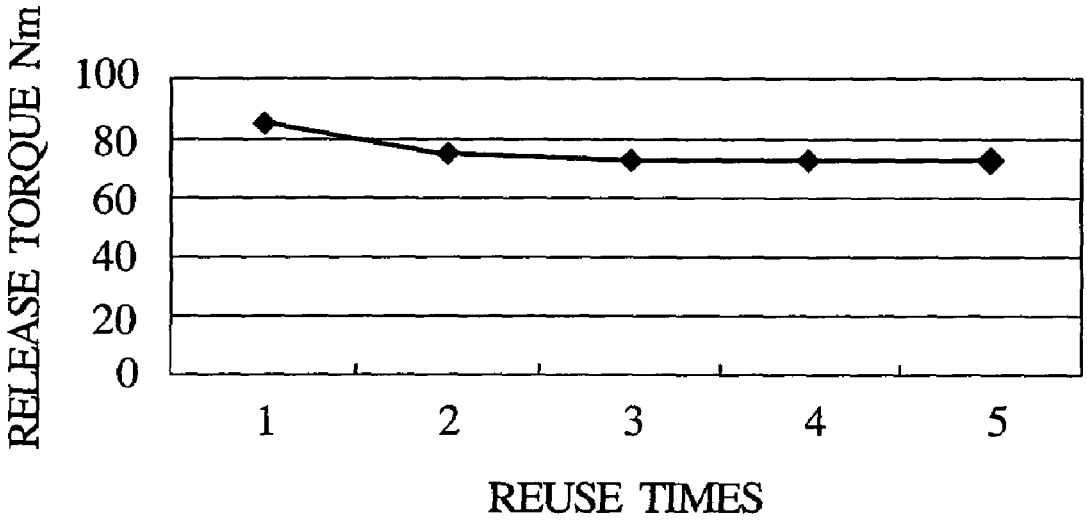
FIG. 13 is a graph showing results where release torque is repeatedly measured relative to the power transmission in FIG. 8.

Referring to FIG. 13, release torque of leaf spring 12B and protrusion 6 is repeatedly measured five times. The test's object is the identical leaf spring 12B and protrusion 6. That is, after disengagement of the leaf spring 12B and protrusion 6 from each other, the leaf spring 12B and protrusion 6 is engaged again for test. As a result, release torques are stabilized at about 80 Nm.

Next, the fourth embodiment of the invention is described.

Figure 14A:
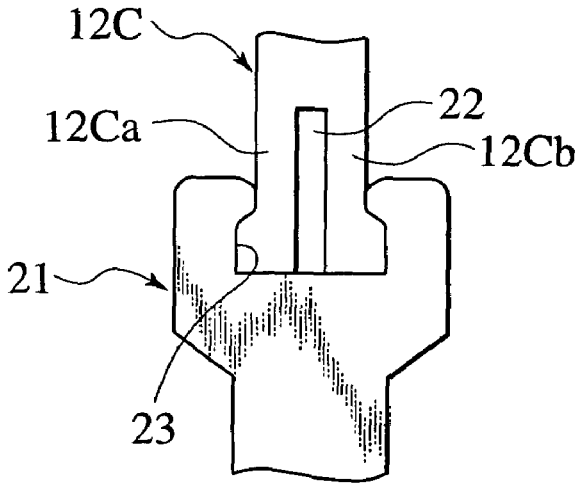
FIGS. 14A and 14B are enlarged elevation views of a leaf spring that is adapted for the power transmission according to the fourth embodiment.

In FIG. 14A, a leaf spring 12C has an end with both sides projecting transversely outward. The leaf spring 12C has side-pieces 12C*a*, 12C*b* at the end. The side pieces 12C*a*, 12C*b* are opposed to each other, with a slit 22 intervening between the side-pieces 12C*a*, 12C*b* at the end. The side pieces 12C*a*, 12C*b* are resiliently deformable. The slit 22 extends longitudinally from the end edge to the other end of the leaf spring 12C. The hub 10 has locking parts 21 with fitting recess 23 in which the end of leaf spring 12C is fitted.

Figure 14B:
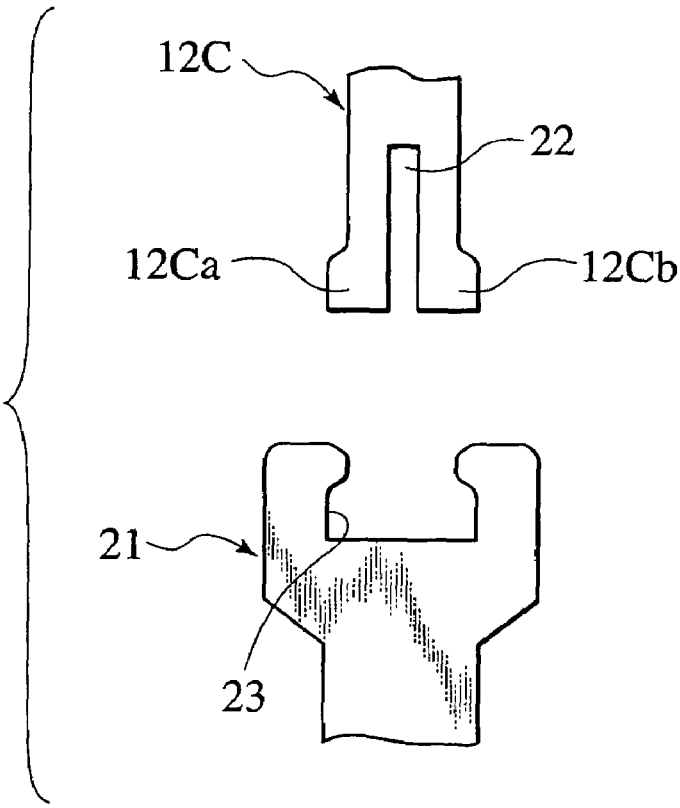

It is supposed that the clutchless compressor has a load torque less than a predetermined value. The side-pieces 12C*a*, 12G*b* at the end of leaf spring 12C is maintained to fit in the fitting recess 23 of locking part 21, as shown in FIG. 14A. With load torque over a predetermined value, the end or side pieces 12C*a*, 12G*b* of leaf spring 12C is resiliently deformed, with the width being reduced. The leaf spring 12C is disengaged from the fitting recess 23, thus cutting off power, as shown in FIG. 14B.

Although the invention has been described above by reference to certain embodiments of the invention, the invention is not limited to the embodiments described above. Modifications and variations of the embodiments described above will occur to those skilled in the art, in light of the above teachings. The scope of the invention is defined with reference to the following claims.

The entire contents of Japanese Patent Applications P2003-8315 (filed Jan. 16, 2003), P2003-8309 (filed Jan. 16, 2003), P2002-306139 (filed Oct. 21, 2002), and P2002-306124 (filed Oct. 21, 2002) are incorporated herein by reference.

According to the invention, a power transmission is manufactured with a small number of components and production steps. This shortens production time and reduces production cost. The arrangement of a link reduces a shaft in the axial dimension.

The link does not contact with the other member of the driven member and the drive member after cutting off power, and noise does not occurs.

The invention requires no riveting for preventing the link from coming out of a first or second engagement member. This further shortens production time and reduces production cost.

The link includes plates of an identical shape and dimension, which enhances workability during stamping and dimensional accuracy. In addition, in comparison with a link of a single plate, torque is further stabilized, when excessive torque cuts off transmission of power.

The link resists time-varying or wearing, which stabilizes the threshold value of load torque, enhancing reliability.

The influence on the link, depending on variation of strength and dimension, is reduced, which facilitating cutting off of power due to the threshold value of a desired load torque, thus enhancing reliability.

What is claimed is:

1. A power transmission for a compressor, comprising:

a driven member rotatable by an engine;

a drive member rotatable coaxially with the driven member to rotate a drive shaft of a compressor for regulating displacement of the compressor;

a link interconnecting the driven member and the drive member with each other in a crossing direction relative, to the drive shaft, the link being disengageable from the drive member;

a first engagement member fixed to the drive member; and a resilient locking member provided in the driven member, the resilient locking member configured to lock with the link disengaged from the drive member by slidably pressing against the driven member;

wherein said link has a hole at a first end portion thereof and an open end slot at a second end portion thereof which releasably receives said first engagement member, the second end portion being opposite to the first end portion; and wherein said link is rotatably mounted to the driven member so as to remain engaged with the driven member.

2. The power transmission according to claim 1, wherein the driven member includes a second engagement member, and wherein the hole is fitted with the second engagement member.

3. The power transmission according to claim 2, wherein the first engagement member is deformable.

4. The power transmission according to claim 2, wherein the first engagement member is integrated with the drive member, and the second engagement member is integrated with the driven member.

5. The power transmission according to claim 2, wherein the link is interposed between the driven member and the drive member.

6. The power transmission according to claim 2, wherein the first engagement member passes through the open end slot to disengage from the link.

7. The power transmission according to claim 1, wherein links are arranged about the shaft at an equal angular interval.

8. A power transmission for a compressor, comprising:

a driven member rotatable by an engine;

a drive member rotatable coaxially with the driven member to rotate a drive shaft of a compressor for regulating displacement of the compressor;

a link interconnecting the driven member and the drive member with each other in a crossing direction relative to the drive shaft, the link being disengageable from the driven member;

a first engagement member fixed to the driven member; and a resilient locking member provided in the drive member, the resilient locking member configured to lock with the link disengaged from the driven member by slidably pressing against the drive member;

wherein said link has a hole at a first end portion thereof and an open end slot at a second end portion thereof which releasably receives said first engagement member, the second end portion being opposite to the first end portion; and wherein said link is rotatably mounted to the drive member so as to remain engaged with the drive member.

9. The power transmission according to claim 8, wherein the drive member includes a second engagement member, and wherein the hole is fitted with the second engagement member.

10. The power transmission according to claim 9, wherein the first engagement member is deformable.

11. The power transmission according to claim 9, wherein the first engagement member is integrated with the driven member, and wherein the second engagement member is integrated with the drive member.

12. The power transmission according to claim 9, wherein the link is interposed between the driven member and the drive member.

13. The power transmission according to claim 8, wherein the link includes plates of an identical shape and dimension stacked on each other.

14. The power transmission according to claim 9, wherein the first engagement member passes through the open end slot to disengage from the link.

15. The power transmission according to claim 8, wherein links are arranged about the shaft at an equal angular interval.

* * * * *